US012698123B1

(12) United States Patent
Kick

(10) Patent No.: US 12,698,123 B1
(45) Date of Patent: Aug. 4, 2026

(54) CONTAINER

(71) Applicant: BUZZBALLZ, LLC, Carrollton, TX (US)

(72) Inventor: Merrilee Kick, Plano, TX (US)

(73) Assignee: BUZZBALLZ, LLC, Carrollton, TX (US)

( * ) Notice: Subject to any disclaimer, the term of this patent is extended or adjusted under 35 U.S.C. 154(b) by 0 days.

(21) Appl. No.: 18/883,968

(22) Filed: Sep. 12, 2024

Related U.S. Application Data

(63) Continuation of application No. 29/950,209, filed on Jul. 1, 2024, now Pat. No. Des. 1,058,370, which is a continuation of application No. 29/930,383, filed on Feb. 29, 2024, now Pat. No. Des. 1,034,196, which is a continuation of application No. 18/506,811, filed on Nov. 10, 2023, now Pat. No. 11,932,441, which is a continuation of application No. 29/824,813, filed on Jan. 27, 2022, now abandoned, which is a continuation of application No. 16/800,195, filed on Feb. 25, 2020, now Pat. No. 11,338,955, which is a continuation of application No. 12/762,934, filed on Apr. 19, 2010, now Pat. No. 10,604,296.

(51) Int. Cl.
*B65D 1/16* (2006.01)
*B65D 17/28* (2006.01)

(52) U.S. Cl.
CPC ..... *B65D 1/165* (2013.01); *B65D 1/16* (2013.01); *B65D 17/4012* (2018.01)

(58) Field of Classification Search
CPC ..... B65D 17/4012; B65D 1/16; B65D 1/165; B65D 1/10; B65D 1/12; B65D 1/14; B65D 2501/00; B65D 2501/0009
USPC ..... 220/269, 608, 669
See application file for complete search history.

(56) References Cited

U.S. PATENT DOCUMENTS

| | | | |
|---|---|---|---|
| 925,861 | A | 6/1909 | Booth |
| D48,160 | S | 11/1915 | Samuelson |
| D49,555 | S | 8/1916 | Vivaudou |
| D106,034 | S | 9/1937 | Harrison |

(Continued)

FOREIGN PATENT DOCUMENTS

| | | | |
|---|---|---|---|
| CA | 1222211 | A | 5/1987 |
| CN | 212530398 | U | 2/2021 |

(Continued)

OTHER PUBLICATIONS

Translation of Office Action with Search Report for Taiwanese Design Patent Application No. 111301016, issued Aug. 31, 2022; 3 pages.

(Continued)

*Primary Examiner* — Nathan J Jenness
*Assistant Examiner* — Madison L Poos
(74) *Attorney, Agent, or Firm* — HAYNES AND BOONE, LLP

(57) ABSTRACT

A container for storing a liquid or a solid may include a container body having a container side wall and a container bottom and a container lid having a pop top arm to pivot and cooperate with a weakened area to provide access to the interior of the container body. The container body may be formed from plastic and the container lid is formed from metal, and the container body may include a vertical neck. The container body may include a lip, and the bottom wall may include a center protrusion. The bottom wall may include a depression, and the bottom wall may include a radial extending depression.

75 Claims, 9 Drawing Sheets

(56) References Cited

U.S. PATENT DOCUMENTS

| | | | |
|---|---|---|---|
| 2,098,823 | A | 11/1937 | Gurley |
| D130,876 | S | 12/1941 | Reid |
| 2,745,642 | A | 5/1956 | Hermann |
| D179,227 | S | 11/1956 | Strong |
| D183,310 | S | 8/1958 | Hack |
| D183,433 | S | 8/1958 | Van Baarn |
| 2,978,142 | A | 4/1961 | Novick |
| 3,179,036 | A | 4/1965 | Jackson |
| 3,314,569 | A | 4/1967 | Seiferth |
| 3,384,265 | A | 5/1968 | Frank |
| D223,898 | S | 6/1972 | Edwards |
| D224,516 | S | 8/1972 | Amberg |
| 3,768,700 | A | 10/1973 | Stranicky |
| D235,193 | S | 5/1975 | Edwards |
| 4,140,464 | A | 2/1979 | Spurr et al. |
| D254,716 | S | 4/1980 | Mascia |
| D255,988 | S | 7/1980 | Mascia et al. |
| D259,292 | S | 5/1981 | Conrad |
| D287,767 | S | 1/1987 | Simmons |
| D292,462 | S | 10/1987 | Petrasek |
| 4,936,482 | A | 6/1990 | Gallagher et al. |
| 5,137,162 | A | 8/1992 | Fritz |
| D352,898 | S | 11/1994 | Vacher |
| 5,407,086 | A | 4/1995 | Ota |
| D375,226 | S | 11/1996 | Blankenburg et al. |
| 5,638,982 | A | 6/1997 | Spector |
| D381,561 | S | 7/1997 | Manca |
| 5,645,190 | A | 7/1997 | Goldberg |
| D383,646 | S | 9/1997 | Jeppesen |
| 5,740,914 | A | 4/1998 | Herzog |
| 5,799,792 | A | 9/1998 | Abrums |
| D405,639 | S | 2/1999 | Clark et al. |
| D416,173 | S | 11/1999 | Hersch |
| D427,514 | S | 7/2000 | Roth et al. |
| 6,293,422 | B1 | 9/2001 | Jentzsch et al. |
| D448,666 | S | 10/2001 | Fields |
| 6,375,031 | B1 | 4/2002 | Kwan |
| D460,693 | S | 7/2002 | Flowers |
| 6,574,883 | B2 | 6/2003 | Giblin et al. |
| 6,666,001 | B2 | 12/2003 | Mero |
| 6,793,094 | B2 | 9/2004 | Turnbough |
| D509,742 | S | 9/2005 | Biondich et al. |
| D511,654 | S | 11/2005 | Bailey |
| D512,917 | S | 12/2005 | Frisch et al. |
| 7,051,892 | B1 | 5/2006 | O'Day |
| D547,197 | S | 7/2007 | Hermel |
| D554,523 | S | 11/2007 | Polina |
| D562,685 | S | 2/2008 | Millspaw et al. |
| D565,413 | S | 4/2008 | Honkawa et al. |
| D575,108 | S | 8/2008 | Barducci |
| D582,213 | S | 12/2008 | Kehrein et al. |
| D584,948 | S | 1/2009 | Bourne |
| D585,745 | S | 2/2009 | Honkawa |
| D596,489 | S | 7/2009 | Weiss |
| D606,404 | S | 12/2009 | Diss |
| D606,405 | S | 12/2009 | Takata et al. |
| D612,732 | S | 3/2010 | Takata et al. |
| D614,971 | S | 5/2010 | Millspaw et al. |
| 7,726,483 | B2 | 6/2010 | Ramanujam et al. |
| 7,731,053 | B2 | 6/2010 | Ivey |
| 7,784,639 | B2 | 8/2010 | Milkowski et al. |
| D634,635 | S | 3/2011 | Araujo et al. |
| D650,280 | S | 12/2011 | de Peyerimhoff et al. |
| D663,619 | S | 7/2012 | Pillet |
| D674,237 | S | 1/2013 | Zimmer |
| D675,528 | S | 2/2013 | Beaver |
| D699,578 | S | 2/2014 | Marina et al. |
| D701,767 | S | 4/2014 | Marina et al. |
| D703,068 | S | 4/2014 | Kick |
| D704,567 | S | 5/2014 | Sanders |
| D711,247 | S | 8/2014 | Sanders |
| D732,978 | S | 6/2015 | Kick |
| D739,245 | S | 9/2015 | Dachs et al. |
| D739,267 | S | 9/2015 | Kick |
| D740,029 | S | 10/2015 | Otto et al. |
| D772,722 | S | 11/2016 | Kick |
| 9,522,482 | B2 | 12/2016 | Milkowski et al. |
| D803,376 | S | 11/2017 | Gobber et al. |
| D807,189 | S | 1/2018 | Hanan et al. |
| D809,391 | S | 2/2018 | Funk |
| D820,106 | S | 6/2018 | Jasani |
| 10,336,496 | B2 | 7/2019 | Zimmer |
| D864,725 | S | 10/2019 | Staab et al. |
| 10,604,296 | B2 | 3/2020 | Kick |
| 10,617,781 | B2 | 4/2020 | Cholet et al. |
| D889,266 | S | 7/2020 | Pun |
| D911,179 | S | 2/2021 | Kick |
| D911,843 | S | 3/2021 | Kick |
| 10,981,706 | B2 | 4/2021 | Minnette et al. |
| D951,493 | S | 5/2022 | Wang |
| 11,484,152 | B2 | 11/2022 | Kick |
| D976,704 | S | 1/2023 | Stammen |
| D996,218 | S | 8/2023 | Sha |
| 11,738,903 | B2 | 8/2023 | Kick |
| 11,738,904 | B2 | 8/2023 | Kick |
| D1,013,512 | S | 2/2024 | Kick |
| 11,932,441 | B1 | 3/2024 | Kick |
| D1,023,762 | S | 4/2024 | Kick |
| D1,025,491 | S | 4/2024 | Sha |
| 11,975,889 | B2 | 5/2024 | Kick |
| D1,034,196 | S | 7/2024 | Kick |
| 12,037,162 | B1 | 7/2024 | Kick |
| D1,058,370 | S | 1/2025 | Kick |
| D1,080,384 | S | 6/2025 | Kick |
| 2004/0031818 | A1 | 2/2004 | Killoran et al. |
| 2006/0000841 | A1 | 1/2006 | Smay et al. |
| 2007/0029325 | A1 | 2/2007 | Herold |
| 2007/0045218 | A1 | 3/2007 | Afandyan |
| 2007/0131700 | A1 | 6/2007 | Honkawa et al. |
| 2009/0307924 | A1 | 12/2009 | Aouad et al. |
| 2010/0133729 | A1 | 6/2010 | Shah |
| 2012/0187069 | A1 | 7/2012 | Harris et al. |
| 2014/0061328 | A1 | 3/2014 | Haymond |
| 2015/0257558 | A1 | 9/2015 | May et al. |
| 2015/0344177 | A1 | 12/2015 | Kick |
| 2016/0167825 | A1 | 6/2016 | Dachs et al. |
| 2018/0118401 | A1 | 5/2018 | Zimmer |
| 2018/0134447 | A1 | 5/2018 | Zimmer |
| 2019/0009952 | A1 | 1/2019 | Pedmo et al. |
| 2020/0262601 | A1 | 8/2020 | Kick |
| 2021/0107111 | A1 | 4/2021 | Kick |
| 2023/0021579 | A1 | 1/2023 | Zabaleta et al. |
| 2023/0064312 | A1 | 3/2023 | Kick |
| 2023/0391501 | A1 | 12/2023 | Kick |

FOREIGN PATENT DOCUMENTS

| | | | |
|---|---|---|---|
| CR | 20130449 | S | 3/2014 |
| DE | 3919835 | C2 | 2/1991 |
| DE | 3406986 | C2 | 10/1992 |
| DE | 102004046423 | A1 | 12/2005 |
| EM | 000996939-0001 | | 4/2008 |
| EM | 001155980-0023 | | 8/2009 |
| EM | 001632233-0002 | | 11/2009 |
| EP | 761552 | A1 | 3/1997 |
| EP | 1177988 | A1 | 2/2002 |
| EP | 0870593 | B1 | 10/2002 |
| EP | 2022751 | A3 | 8/2009 |
| EP | 2271474 | B1 | 5/2017 |
| EP | 3080007 | B1 | 8/2020 |
| FR | 2716435 | A1 | 5/1996 |
| FR | 2782702 | A1 | 3/2000 |
| JP | 05032248 | A | 2/1993 |
| JP | H11208633 | A | 8/1999 |
| JP | D1608809 | S | 7/2021 |
| KR | 3006720360000 | S | 1/2014 |
| KR | 10-2016771 | B1 | 10/2019 |
| TW | D180616 | S | 1/2017 |
| WO | 2004101372 | A1 | 11/2004 |
| WO | WO-2005049434 | A1 | 6/2005 |
| WO | WO-2006029441 | A1 | 3/2006 |

(56) References Cited

FOREIGN PATENT DOCUMENTS

| | | | |
|---|---|---|---|
| WO | WO2007058500 | A1 | 5/2007 |
| WO | WO-2009072910 | A2 | 6/2009 |

OTHER PUBLICATIONS

Office Action for related U.S. Appl. No. 29/824,813, mailed Oct. 6, 2022; 7 pages.
Office Action for related U.S. Appl. No. 29/824,813, mailed Feb. 15, 2023; 8 pages.
Office Action for related U.S. Appl. No. 29/824,813, mailed Jun. 20, 2023; 11 pages.
Andrews, A Fishkeeper's Guide to Fancy Goldfishes, Tetra Press No. 16058, 1987, Salamander Books Ltd., Morris Plains, NJ, 4 pages.
U.S. Registration No. 549,097, Miscellaneous Juice Bottle Design, File History retrieved May 3, 2024, 96 pages.
Decorating for all Seasons, General Foam Plastics Corporation Catalog, Pumpkin Buckets, 2005, Norfolk, VA, 23 pages.
DW Staff, McDonald's, Coke Run Afoul of German Law with Ball-Bottle, Published Jun. 2, 2006, Screenshot dated May 6, 2024, Retrieved from www.dw.com.
Staff Writer, Coke Kicks Off World Cup Activity, Published Apr. 24, 2006, Screenshot dated May 6, 2024, Retrieved from www.talkingretail.com.
Football Shaped Diet Coke Bottle on a White Background, Promotional Bottle to Celebrate the 2006 World Cup, May 12, 2006, Screenshot May 6, 2024, Retrieved from www.alamy.com.
Hoffman, Coca Cola 2009 Holiday Ornament Bottles, Published Nov. 30, 2009, Screenshot dated May 6, 2024, Retrieved from thedieline.com.
The JoyServe Store, 16 Oz Plastic Fish Bowl (12 Pack) 4 Inch Heavy Duty Plastic Ivy Bowls, for Candy, Carnival Games, Prizes, Centerpieces, and Party Decoration Supplies, BPA-Free, retrieved from www.amazon.com, 10 pages.
USPTO PTAB Case No. IPR2024-01000, U.S. Pat. No. 11,932,441, *MPL Brands NV, Inc.* Petitioner, v. *Buzzballz, LLC* Patent Owner, Decision Denying Institution of Inter Partes Review, dated Dec. 18, 2024, 4 pages.
USPTO PTAB Case No. PGR2024-00035, U.S. Pat. No. 11,932,441, *MPL Brands NV, Inc.* Petitioner, v. *Buzzballz, LLC* Patent Owner, Decision Granting Institution of Post-Grant Review, dated Dec. 18, 2024, 51 pages.
USPTO PTAB Case No. IPR2024-01098, U.S. Pat. No. 11,738,904, *MPL Brands NV, Inc.* Petitioner, v. *Buzzballz, LLC* Patent Owner, Decision Granting Institution of Inter Partes Review, dated Jan. 27, 2025, 34 pages.
United States District Court for the Western District of Texas San Antonio Division, Civil Action No. 5:24-cv-00692, *Buzzballz, LLC,* Plaintiff v. *The Beverage Ranch, LLC*, Defendant, Defendant's Supplemental Production of Invalidating Prior Art, 2 pages.
Pinterest: 1980 Chambord Liqueur Royale de France boisson alcoolisee, BR_PA_000970, 1 page.
Ebay: 1985 Chambord Liqieur Preserves Ad - From France & Royal Family, BR_PA_000971, 1 page.
Whisky.Auction: Chambord Black Raspberry: Bottled 1980s-1990s, BR_PA_000972, 1 page.
Wikipedia: Globus Cruciger, BR_PA_000973, 1 page.
Fabbri 1905: Our History, BR_PA_000974-BR_PA_001000, 27 pages.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, dated Jun. 7, 2024, 271 pages.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1001, U.S. Pat. No. 11,932,441 B1 ("'441 patent").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1002, Declaration of Nathan J. Delson, PhD ("Delson").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1003, Prosecution File History of Design U.S. Appl. No. 29/824,813.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1004, Prosecution File History of '441 patent.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1005, Declaration of Joseph T. Norris ("Norris").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1006, Coca-Cola Plastic Can Marketing Material.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1007, The American Heritage Dictionary.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1008, U.S. Pat. No. 8,524,349 B2 to Protais et al. ("Protais").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1009, U.S. Pat. No. 4,405,546.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1010, U.S. Pat. No. 8,141,741 B2 to Metzger et al. ("Metzger").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1011, U.S. Pat. No. 4,465,204 to Kaminski ("Kaminski").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1012, U.S. Pat. No. 6,729,495 B2 to Gardiner ("Gardiner").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1013, U.S. Pat. No. 6,585,123 B1 to Pedmo et al. ("Pedmo").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1014, U.S. Pat. No. 4,024,981 to Brown ("Brown").
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1015, The 1985 Los Angeles Times Article.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1016, The 1985 New York Times Article.
USPTO PTAB Case No. PGR2024-00035, U.S. Pat. No. 11,932,441, *MPL Brands NV, Inc.* Petitioner, v. *Buzzballz, LLC* Patent Owner, Petition for Post-Grant Review of U.S. Pat. No. 11,932,441, Ex. 1017, Handbook of Engineering and Specialty Thermoplastics.
USPTO PTAB Case No. IPR2024-01000, U.S. Pat. No. 11,932,441, *MPL Brands NV, Inc.* Petitioner, v. *Buzzballz, LLC* Patent Owner, Petition for Inter Partes Review of U.S. Pat. No. 11,932,441, dated Jun. 7, 2024, 196 pages.
USPTO PTAB Case No. IPR2024-01098, U.S. Pat. No. 11,738,904, *MPL Brands NV, Inc.* Petitioner, v. *Buzzballz, LLC* Patent Owner, Petition for Inter Partes Review of U.S. Pat. No. 11,738,904, dated Jul. 17, 2024, 104 pages.

(56) References Cited

OTHER PUBLICATIONS

USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1001, U.S. Pat. No. 11,738,904 B2.
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1002, Declaration of Nathan J. Delson, Ph.D. ("Delson").
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1003, Prosecution History of U.S. Pat. No. 11,738,904 B2.
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1004, Prosecution History of U.S. Pat. No. 10,604,296 B2.
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1005, Comparison of Original and Amended Specifications.
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1006, Prosecution History of U.S. Pat. No. 11,338,955 B2.
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1007, U.S. Patent Publication 2011/0253720 A1 ("Kick").
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1008, German Unexamined Patent Publication 102004046423 A1 ("Ackermann").
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1009, U.S. Pat. No. 4,465,204 ("Kaminski").
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1010, U.S. Patent Publication 2008/0044603 A1 ("Hutchinson").
USPTO PTAB Case No. IPR2024-01098, U.S. Pat. No. 11,738,904, *MPL Brands NV, Inc*. Petitioner, v. *Buzzballz, LLC* Patent Owner, Petition for Inter Partes Review of U.S. Pat. No. 11,738,904, Ex. 1011, The American Heritage Dictionary.
Non-Final Action for related U.S. Ex Parte Reexamination Application No. 90/019,913, dated Aug. 12, 2025, 51 pages.
Andrews, A Fishkeeper's Guide to Fancy Goldfishes, 1987, TetraPress, Salamander Books, p. 20.
Drinkstuff.com, Cocktail Fish Bowls, http://drinkstuff.com/products/product.asp?ID=3707&catID=264&name=Cocktail+Fish+ Bowls, archived by the Internet Archive Wayback Machine on Jan. 7, 2010, 3 pages.
Peters, Bustle, "Captain Morgan's Apple Smash Rum is Basically a Delicious, Booze-y Jolly Rancher," published Aug. 8, 2018, 4 pages.
Homade: "Homade' Has a New Home!," published May 18, 2015, 3 pages.
Murray, The Drinks Report: "New rum in a cannon ball from Captain Morgan," published Sep. 14, 2015, 4 pages.
Gartland, Sports Illustrated: "Russian Company's Novelty World Cup Water Bottle Sets Things on Fire," published May 31, 2018, 4 pages.
Bricker, Disney Tourist Blog: "Star Wars Land's Coca-Cola Thermal Detonators," published Sep. 2, 2019, 14 pages.
My French Indeed Antique: Vintage perfume bottle, circa 1950, 11 pages.
Fonseca Antiques: Vintage perfume bottle with vintage Coke can, circa 1940, 1 page.
United States District Court for the Western District of Texas San Antonio Division, Civil Action No. 5:24-cv-00692, *Buzzballz, LLC*, Plaintiff v. *The Beverage Ranch, LLC*, Defendant, Defendant's Fourth Supplemental Production of Invalidating Prior Art, 2 pages.
United States District Court for the District of Delaware: C.A. No. 1:25-CV-01219-JLH, *Mpact Beverage Solutions, LLC and Stacked Wines, LLC*. v. *Buzzballz, LLC*, Amended Complaint for Declaratory Judgment, dated Nov. 6, 2025, 147 pages.
USPTO PTAB: *MPL Brands NV, Inc*. v. *BuzzBallz, LLC*, PGR2024-00035, U.S. Pat. No. 11,932,441, Judgment: Final Written Decision, entered Nov. 17, 2025, 94 pages.
Final Office Action issued by the U.S. Patent and Trademark Office for U.S. Pat. No. 11,338,955 Ex Parte Reexamination U.S. Appl. No. 90/019,913, dated Dec. 2, 2025, 27 pages.
Advisory Action issued by the U.S. Patent and Trademark Office for U.S. Pat. No. 11,338,955 Ex Parte Reexamination U.S. Appl. No. 90/019,913, dated Feb. 19, 2026, 4 pages.

Thickness of Sidewalls & Volume

View:
Bottom of Container

CONTAINER

CROSS-REFERENCE TO RELATED APPLICATIONS

This application is a continuation of U.S. application Ser. No. 29/950,209, filed on Jul. 1, 2024, which is a continuation of U.S. application Ser. No. 29/930,383, filed on Feb. 29, 2024, now U.S. Patent No. D1,034,196, which is a continuation of U.S. application Ser. No. 18/506,811, filed on Nov. 10, 2023, now U.S. Pat. No. 11,932,441, which is a continuation of U.S. application Ser. No. 29/824,813, filed on Jan. 27, 2022, which is a continuation of U.S. application Ser. No. 16/800,195, filed on Feb. 25, 2020, now U.S. Pat. No. 11,338,955, which is a continuation of U.S. application Ser. No. 12/762,934, filed on Apr. 19, 2010, now U.S. Pat. No. 10,604,296, the entire disclosures of which are hereby incorporated herein by reference.

FIELD OF THE INVENTION

The present invention relates to containers and more particularly to a container having a body which may be formed from plastic and a lid which may be formed from metal.

BACKGROUND

Containers having an easy-open-end have been used with a metal lid and container in order to provide a source of merchandising beer and soda for a number of years. These metal containers are formed from cutting metal and folding the metal to an appropriate shape. Metal however does not lend itself well to being molded, and making a new shape by designing a mold out of the sheet of metal is time-consuming and expensive. Thus, it is difficult to achieve any type of design in order to increase the desirability of the package/container with a metal container. However, the pop top lid is very popular with consumers and fairly inexpensive to purchase. Plastic containers have been molded into various shapes and may include various designs in order to increase the attractiveness of the container.

SUMMARY

A container for storing a liquid or a solid may include a container body having a container side wall and a container bottom, and may include a container lid having an easy-open "pop-top arm" which cooperates with a weakened (scored metal) area which provides access to the interior of the container body. The container may also operate with no lid.

The container body may be formed from plastic and the container lid is formed from metal, and the container body may include a vertical or slightly angled neck. The container body may include a lip, and the bottom wall may include a center protrusion or concave shape. The bottom wall may include a depression, and the bottom wall may include a radial extending depression.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The present invention combines the flexibility and desirability of a container body 105 which may be formed from molding plastic or other appropriate material and a metal lid to cooperate with the container body which may include a pop top (or easy-open) lid 131 to provide access to the user of the contents of the container body.

Figure 1:
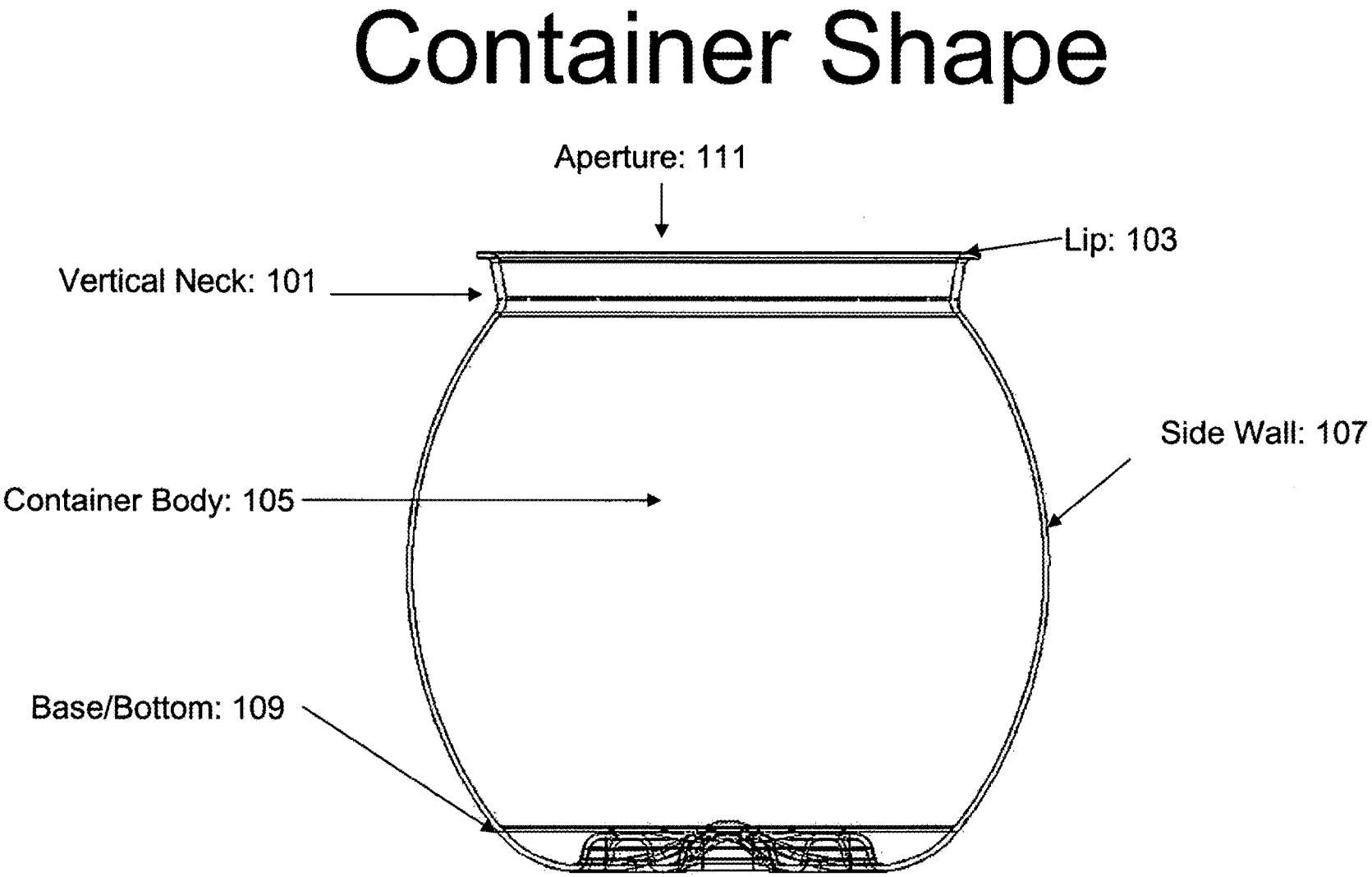
FIG. 1 illustrates a side view of the container body of the present invention.

FIG. 1 illustrates a side view of the container body 105 which may include a side wall 107 which may extend radially around a periphery of the container body 105 and may include a convex side wall 107 or a concave side wall (not shown). The container body 105 may be shaped as a truncated spherical body. The container body 105 may be hollow in order to provide for a solid or liquid which may be dispensed to the user.

The distal end of the container side wall 107 may be connected to a base/bottom wall 109 in order to seal the first end of the container 105 and the proximate end of the container side wall 107 may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (Not shown on FIG. 1, but it is seen on FIGS. 4, 5, and 6) in order to provide a seal so that the liquid or solid within the container body 105 does not leak out.

The container body 105 according to the present invention may be made of an appropriate plastic/synthetic resin, typically polyethylene terephthalate (PET) resin. Alternatively, however, the container 105 may be made from polyamide resin, polycarbonate resin, polyacetal resin, polybuthylene terephthalate resin or other synthetic resin having a sufficient resistance to chemicals. The container may be formed by known molding processes, such as biaxial orientation blow molding process or direct blow molding process or injection blow molding.

Figure 2:
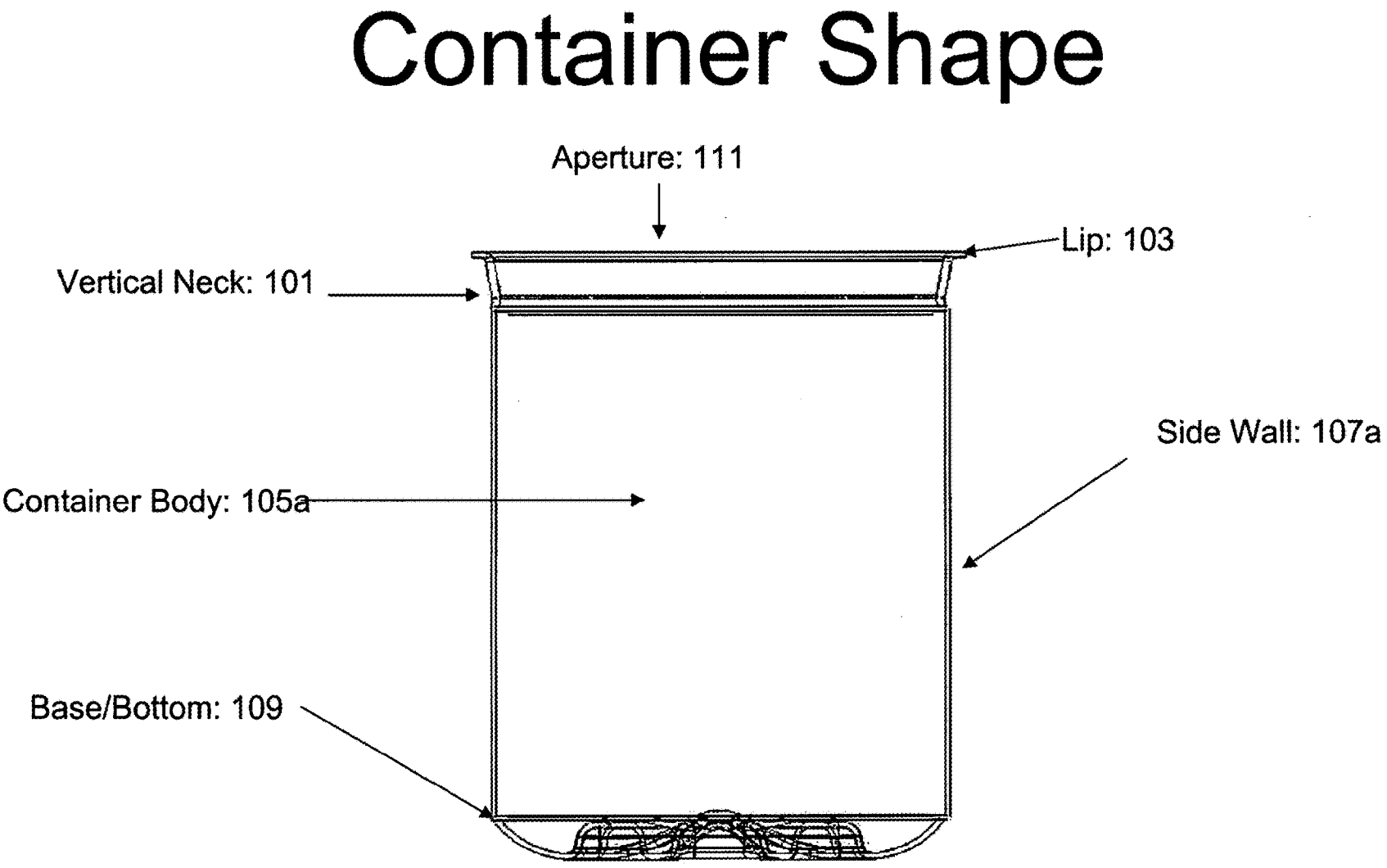
FIG. 2 illustrates a side view of another container body of the present invention.

FIG. 2 illustrates a side view of another container body 105*a* which may include a cylinder side wall 107*a* which may extend radially around a periphery of the container body 105*a* and may include a substantially vertical side wall 107*a*. The container body 105*a* may be hollow in order to provide for a solid or liquid which may be dispensed to the user. The distal end of the container side wall 107*a* may be connected to a base/bottom wall 109 in order to seal the first end of the container 105*a* and the proximate end of the container side wall 107*a* may be connected to a substantially vertical neck 101 around the periphery of the container side wall 107. An aperture 111 may extend through the vertical neck 101 in order to provide access to the liquid/solid within the container body 105. A lip 103 may extend around the periphery of the substantially vertical neck 101 in order to cooperate with the lid 113 (not shown in FIG. 2) in order to provide a seal so that the liquid or solid within the container body 105*a* does not leak out.

The container body of 105*a* may be formed from molded plastic and may be integral without seams or portions of the container body may be formed from molded plastic in sections which may be glued, welded or otherwise attached together.

The container body 105*a* according to the present invention may be made of an appropriate plastic/synthetic resin, typically polyethylene terephthalate (PET) resin. Alternatively, however, the container 105*a* may be made from polyamide resin, polycarbonate resin, polyacetal resin, polybuthylene terephthalate resin or other synthetic resin having a sufficient resistance to chemicals. The container may be formed by known molding processes, such as biaxial orientation blow molding process or direct blow molding process or injection blow molding.

Figure 3:
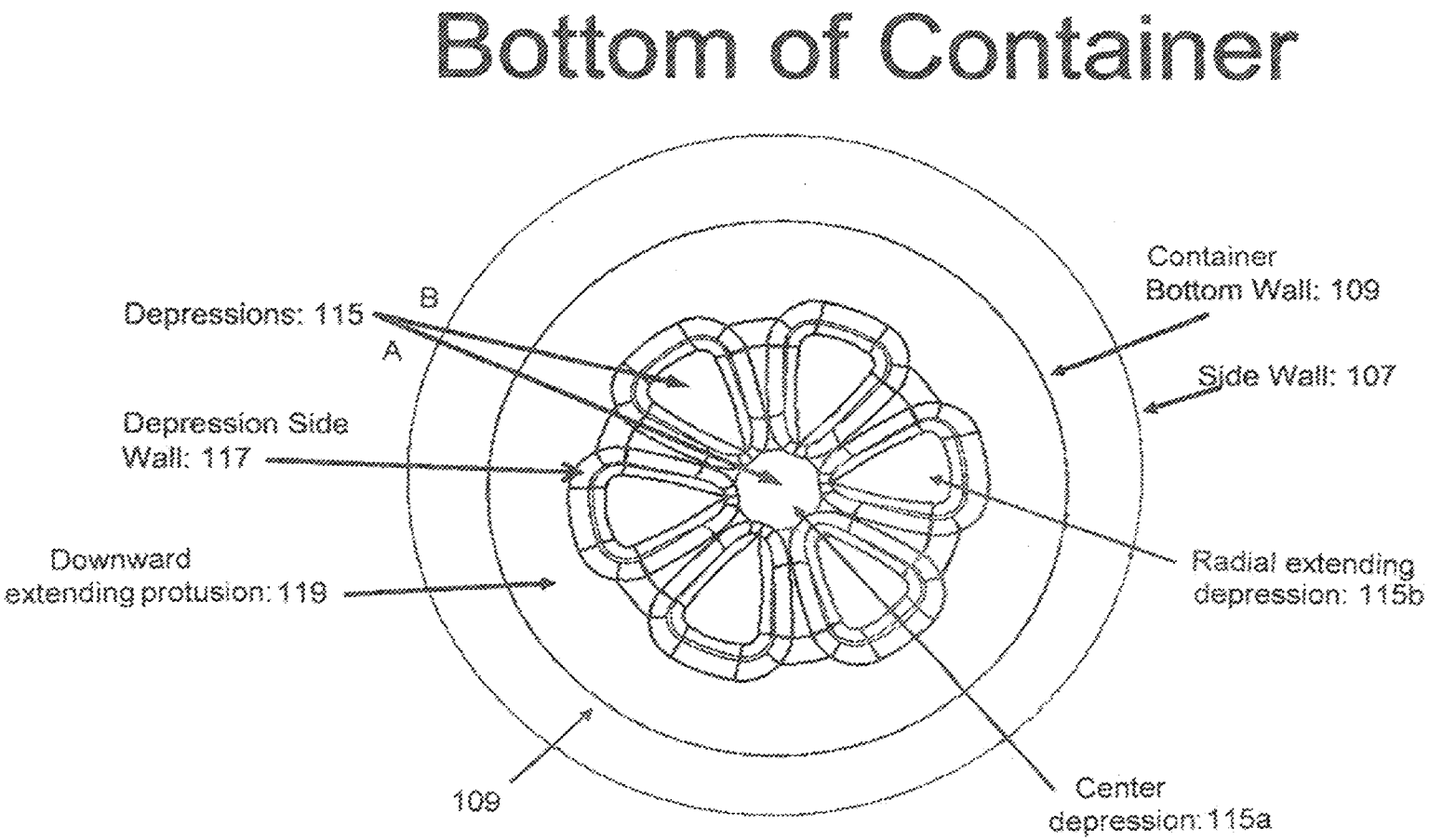
FIG. 3 illustrates a bottom view of the container body of the present invention.

FIG. 3 illustrates a bottom view of the container body and illustrates the container side wall 107 extending radially outwards and illustrates the bottom wall 109 which may be connected to the container side wall 107. The bottom wall 109 may include a multitude of radially extending depressions 115 which may increase in width as the radial distance from the center increases. The depression 115 may be defined by a depression side wall 117 which extends around the periphery of the depression 115. The bottom wall 109 may include a downward extending protrusion 119 which may be centered with respect to the depressions 115 and the bottom wall 109.

Figure 4:
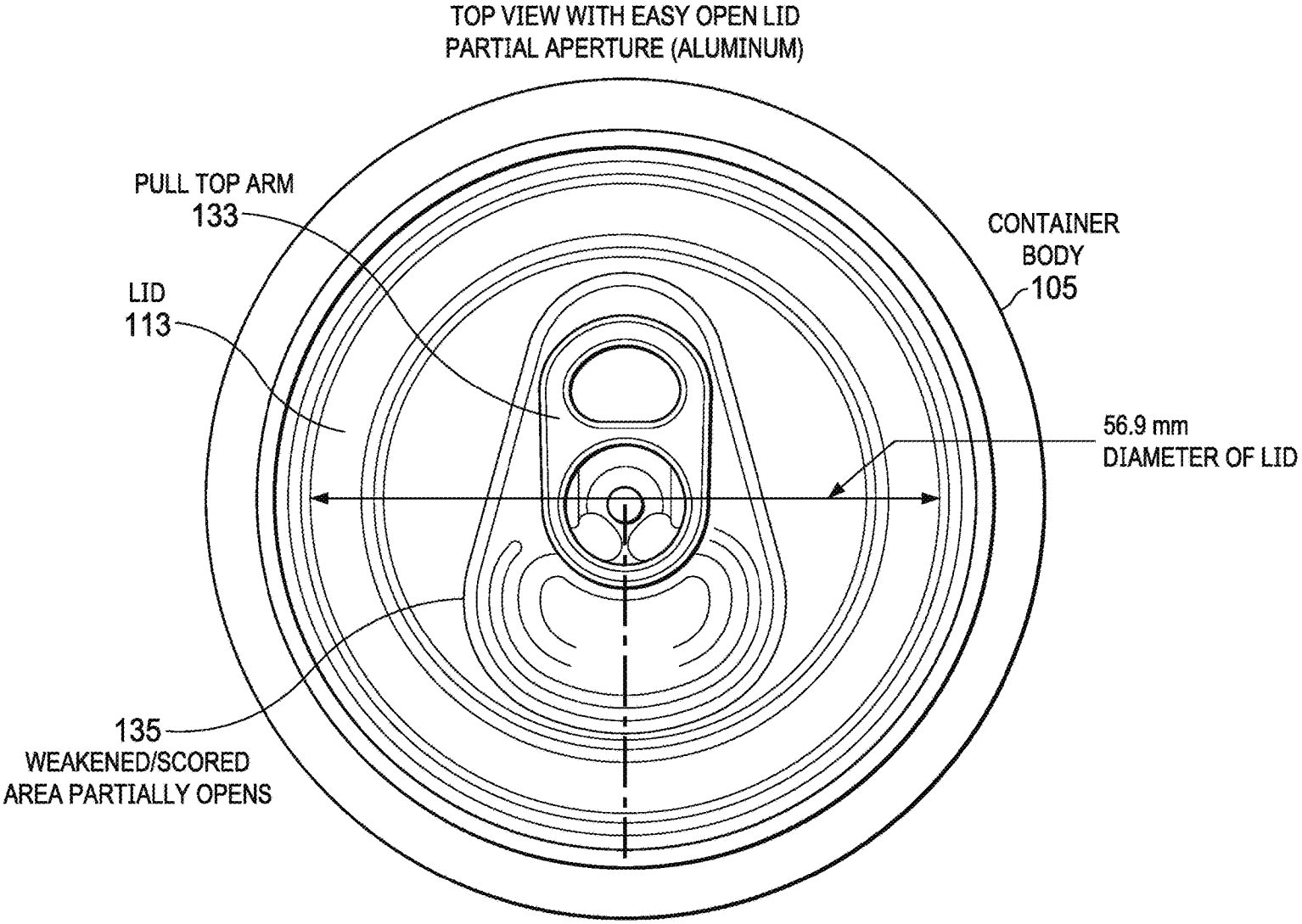
FIG. 4 illustrates a top view of the lids and container body of the present invention.

FIG. 4 illustrates a top view of the container which may include the container body 105 and the container lid 113 which may be deformable in order to provide access to the contents of the container body 105. The container lid 113 may be formed from metal such as steel, aluminum or other types of metals and may include a weakened (or scored) area 135 which deforms and provides an opening when the 'pull top' arm 133 which may include an aperture for a finger of the user and may be pivoted by the user. The weakened/scored area 135 may partially open to provide access to the contents of the container.

Figure 5:
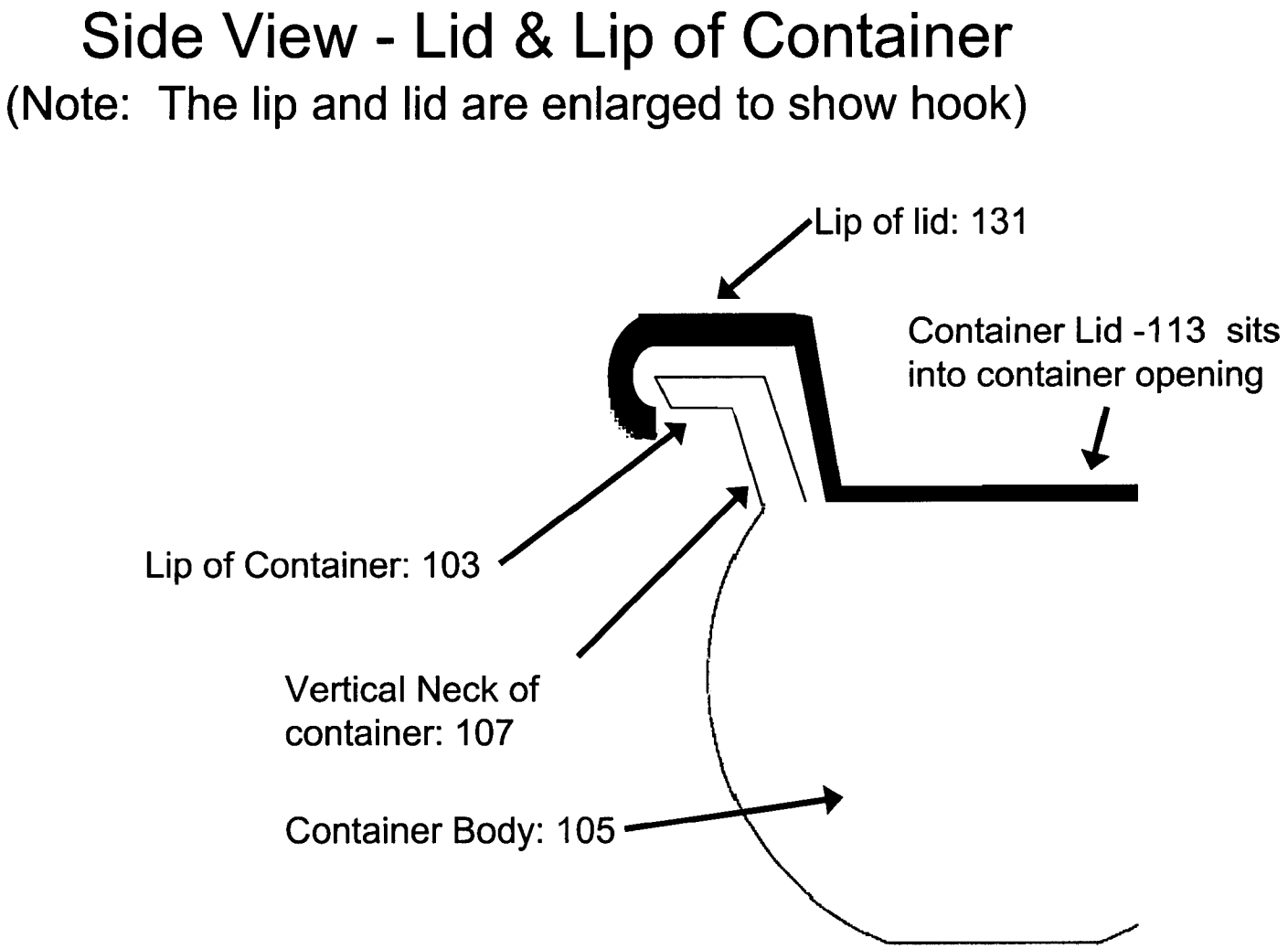
FIG. 5 illustrates a section of the lid and lip of the container body of the present invention.

FIG. 5 illustrates a side view of the container lid 103 which may extend over the vertical neck 107 and may extend around the lip 131 in order to provide a substantially watertight seal/airtight seal for the contents of the container body 105.

Figure 6:
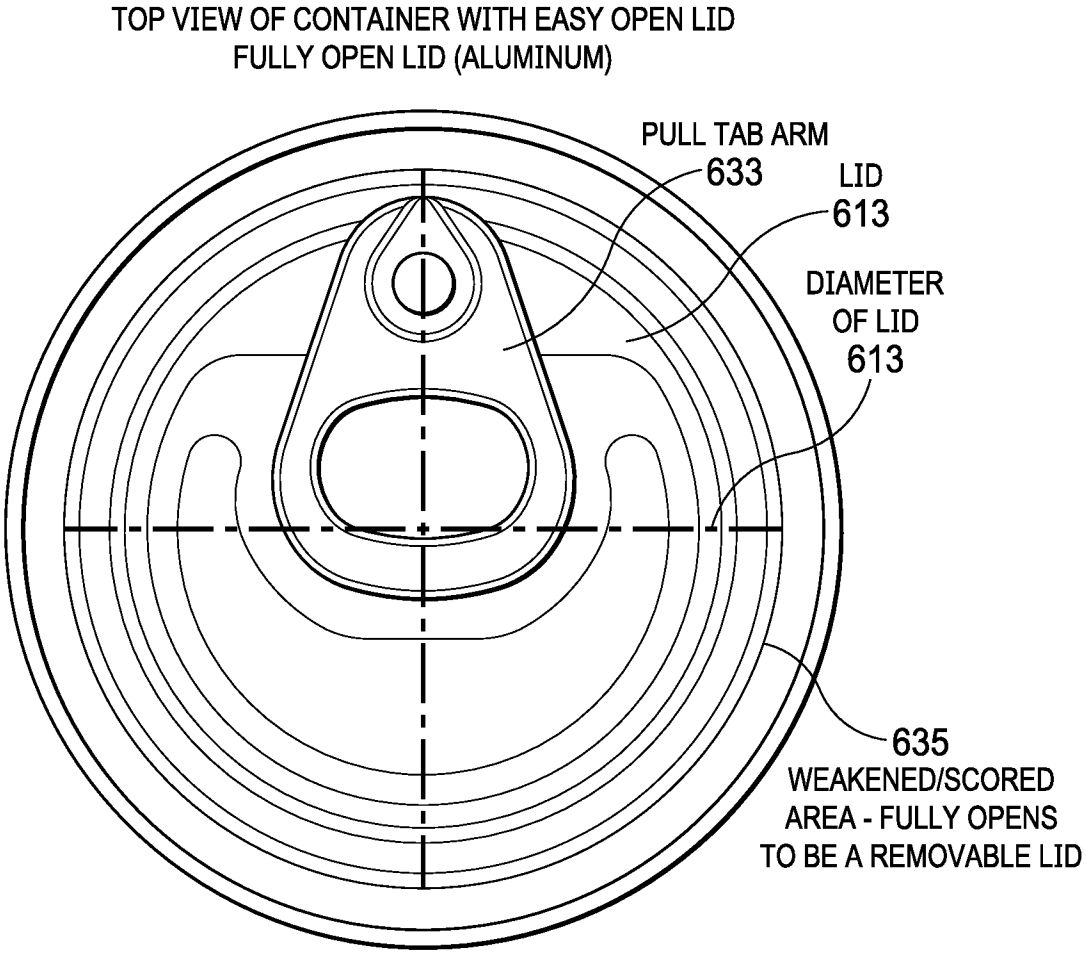
FIG. 6 illustrates another lid for the container body of the present invention.

FIG. 6 illustrates another container lid of the present invention. The container lid 613 may be formed from metal such as steel, aluminum or other types of metals and may include a weakened (or scored) area 635 which deforms and provides an opening when the 'pull tab' arm 633 which may include an aperture for a finger of the user and may be pivoted by the user. The weakened area 635 may extend substantially across the entire lid 613 to provide a full aperture lid to allow the user to add other contents to the container.

Figure 7:
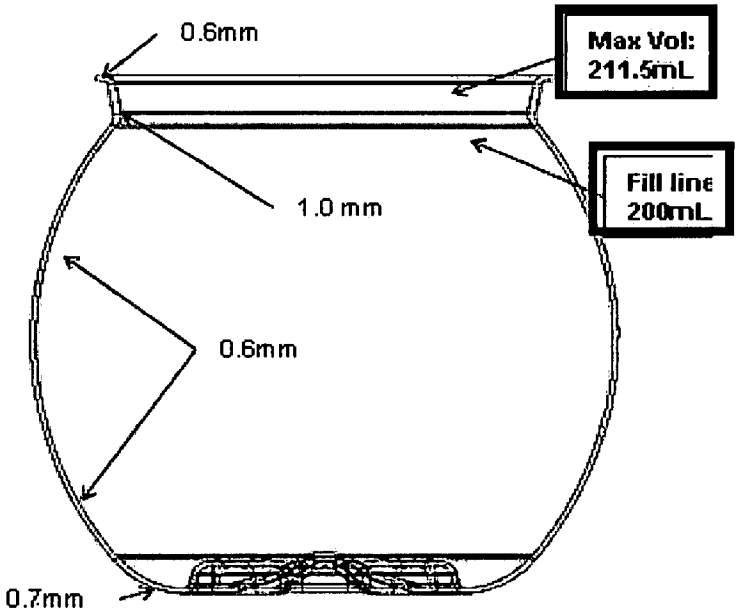
FIG. 7 illustrates the thicknesses of the plastic sidewalls, neck, and flange of the rounded container, and the volume of the rounded container.

FIG. 7 illustrates the thicknesses of the plastic sidewalls, neck and flange. This also illustrates the maximum volume of fluid, and the location for the "fill line" during the container filling process.

Figure 8:
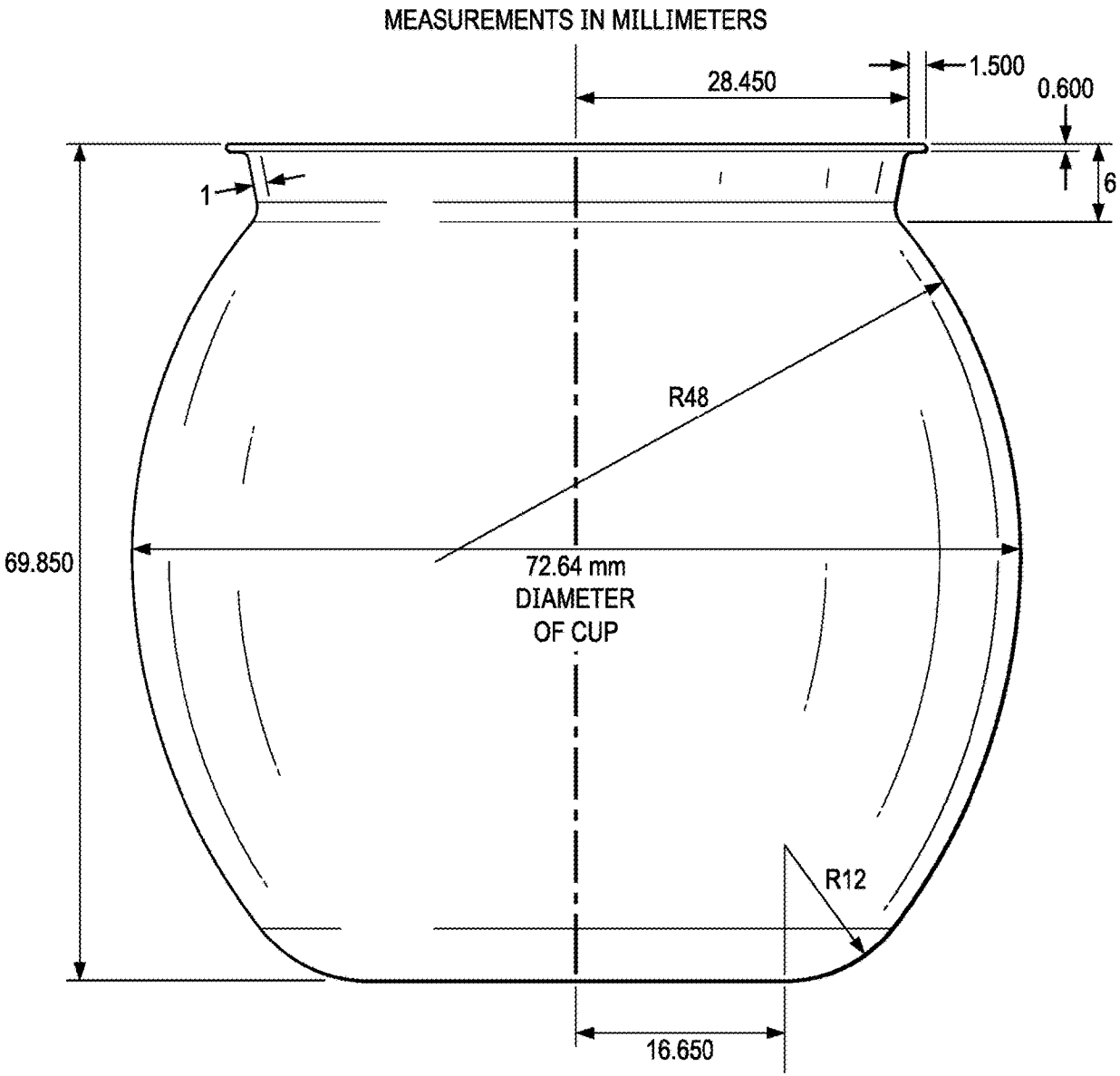
FIG. 8 illustrates the general dimensions of the rounded container in millimeters.

FIG. 8 illustrates the general dimensions of the rounded container in millimeters (cylindrical container measurements not shown from FIG. 2).

Figure 9:
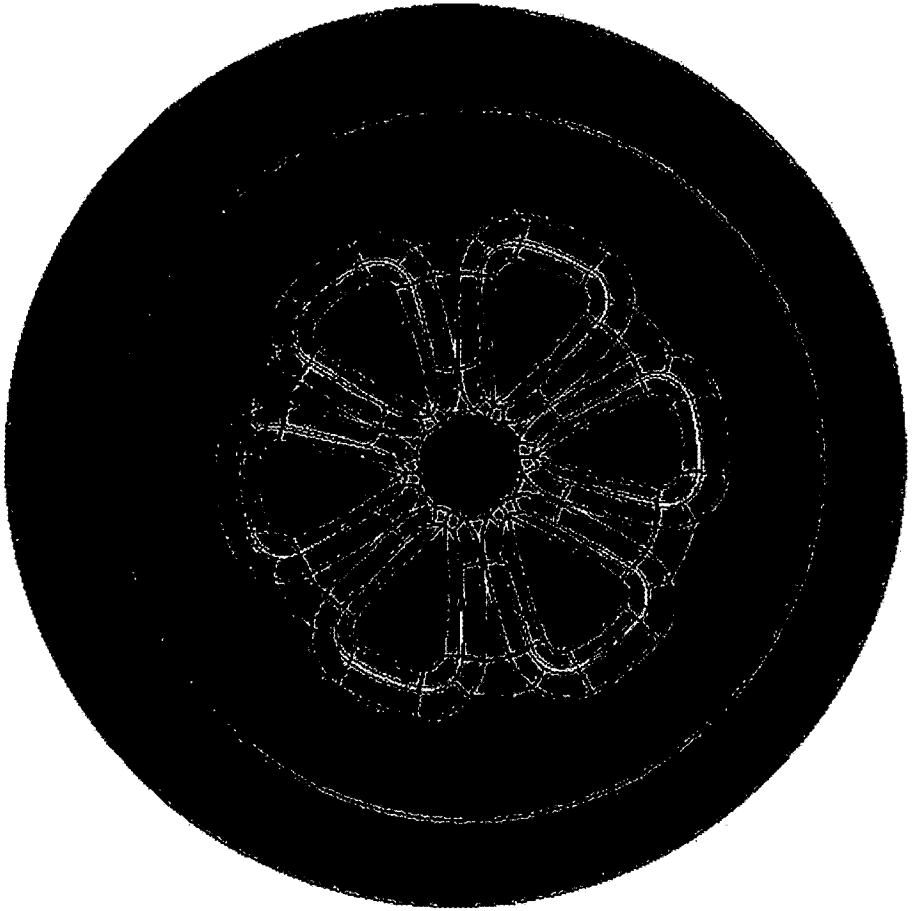
FIG. 9 illustrates a bottom view of the rounded container.

FIG. 9 illustrates the bottom view of the container.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A container, comprising:

a container body, the container body defining a first opening to an interior of the container body; and a lid connected to the container body and covering the first opening to the interior of the container body;

wherein the container body is made out of a resin;

wherein the lid is made out of a metal;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein the container body further comprises a lip at an end of the circular neck opposite the upper boundary of the container side wall;

wherein the circular neck is adjacent to the lip;

wherein a first portion of the lid is above the lip of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape;

wherein the second portion of the lid defines a total area across which the second portion of the lid extends horizontally;

wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape;

wherein the arm comprises opposing first and second end portions;

wherein the arm is pivotable from a first position, in which the weakened or scored area is not deformed, to a second position, in which the weakened or scored area is deformed to provide a second opening to the interior of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the lid cooperates with the lip to provide a seal so that the liquid contained within the container body is sealed against leaking out from between the container body and the lid;

wherein, when the arm of the lid is in the first position and the weakened or scored area is not deformed:

the first end portion of the arm is not positioned above the weakened or scored area of the second portion of the lid; and at least a portion of the second end portion of the arm is positioned above the weakened or scored area of the second portion of the lid;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the one of the lower plurality of cross-sectional diameters that is nearest to the maximum cross-sectional diameter of the middle portion of the container side wall as compared to the other(s) of the lower plurality of cross-sectional diameters; and the upper boundary of the container side wall adjacent to the circular neck of the container body; and wherein the another vertical distance is less than the maximum cross-sectional diameter of the middle portion of the container side wall.

2. The container of claim 1, wherein the resin is a polyethylene terephthalate (PET) resin.

3. The container of claim 2, wherein the metal is aluminum.

4. The container of claim 1, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

5. The container of claim 1, wherein the circular neck defines a first diameter that is vertically spaced from the upper boundary and greater than the diameter of the bottom of the base portion.

6. The container of claim 5, wherein the circular neck further defines a second diameter that is vertically spaced from the first diameter, different in size from the first diameter, and greater than the diameter of the bottom of the base portion.

7. The container of claim 6, wherein the circular neck further defines a third diameter that is adjacent the upper boundary of the container side wall, different in size from each of the first and second diameters, and greater than the diameter of the bottom of the base portion.

8. The container of claim 7, wherein the circular neck extends from the upper boundary of the container side wall so that the second diameter is different from the first diameter and the third diameter is different from each of the first and second diameters.

9. The container of claim 8, wherein the circular neck is angled.

10. The container of claim 9, wherein the circular neck is angled so that the first diameter is greater than the third diameter and the second diameter is greater than each of the first and third diameters.

11. The container of claim 7, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

12. A container, comprising:

a container body, the container body defining a first opening to an interior of the container body; and a lid connected to the container body and covering the first opening to the interior of the container body;

wherein the container body is made out of a resin;

wherein the lid is made out of a metal;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein the container body further comprises a lip at an end of the circular neck opposite the upper boundary of the container side wall;

wherein the circular neck is adjacent to the lip;

wherein a first portion of the lid is above the lip of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape;

wherein the second portion of the lid defines a total area across which the second portion of the lid extends horizontally;

wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape;

wherein the arm comprises opposing first and second end portions;

wherein the arm is pivotable from a first position, in which the weakened or scored area is not deformed, to a second position, in which the weakened or scored area is deformed to provide a second opening to the interior of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the lid cooperates with the lip to provide a seal so that the liquid contained within the container body is sealed against leaking out from between the container body and the lid;

wherein, when the arm of the lid is in the first position and the weakened or scored area is not deformed:

the first end portion of the arm is not positioned above the weakened or scored area of the second portion of the lid; and at least a portion of the second end portion of the arm is positioned above the weakened or scored area of the second portion of the lid;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the bottom of the base portion; and the one of the upper plurality of cross-sectional diameters that is nearest to the maximum cross-sectional diameter of the middle portion of the container side wall as compared to the other(s) of the upper plurality of cross-sectional diameters;

and wherein the another vertical distance is less than the maximum cross-sectional diameter of the middle portion of the container side wall.

13. The container of claim 12, wherein the resin is a polyethylene terephthalate (PET) resin.

14. The container of claim 13, wherein the metal is aluminum.

15. The container of claim 12, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

16. The container of claim 12, wherein the circular neck defines a first diameter that is vertically spaced from the upper boundary and greater than the diameter of the bottom of the base portion.

17. The container of claim 16, wherein the circular neck further defines a second diameter that is vertically spaced from the first diameter, different in size from the first diameter, and greater than the diameter of the bottom of the base portion.

18. The container of claim 17, wherein the circular neck further defines a third diameter that is adjacent the upper boundary of the container side wall, different in size from each of the first and second diameters, and greater than the diameter of the bottom of the base portion.

19. The container of claim 18, wherein the circular neck extends from the upper boundary of the container side wall so that the second diameter is different from the first diameter and the third diameter is different from each of the first and second diameters.

20. The container of claim 19, wherein the circular neck is angled.

21. The container of claim 20, wherein the circular neck is angled so that the first diameter is greater than the third diameter and the second diameter is greater than each of the first and third diameters.

22. The container of claim 18, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

23. A container, comprising:

a container body, the container body defining a first opening to an interior of the container body; and a lid connected to the container body and covering the first opening to the interior of the container body;

wherein the container body is made out of a resin;

wherein the lid is made out of a metal;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein the container body further comprises a lip at an end of the circular neck opposite the upper boundary of the container side wall;

wherein the circular neck is adjacent to the lip;

wherein a first portion of the lid is above the lip of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape;

wherein the second portion of the lid defines a total area across which the second portion of the lid extends horizontally;

wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape;

wherein the arm comprises opposing first and second end portions;

wherein the arm is pivotable from a first position, in which the weakened or scored area is not deformed, to a second position, in which the weakened or scored area is deformed to provide a second opening to the interior of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the lid cooperates with the lip to provide a seal so that the liquid contained within the container body is sealed against leaking out from between the container body and the lid;

wherein, when the arm of the lid is in the first position and the weakened or scored area is not deformed:

the first end portion of the arm is not positioned above the weakened or scored area of the second portion of the lid; and at least a portion of the second end portion of the arm is positioned above the weakened or scored area of the second portion of the lid;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the one of the lower plurality of cross-sectional diameters that is nearest to the maximum cross-sectional diameter of the middle portion of the container side wall as compared to the other(s) of the lower plurality of cross-sectional diameters; and the upper boundary of the container side wall adjacent to the circular neck of the container body;

wherein the another vertical distance is less than the maximum cross-sectional diameter of the middle portion of the container side wall;

wherein yet another vertical distance is defined between:

the bottom of the base portion; and the one of the upper plurality of cross-sectional diameters that is nearest to the maximum cross-sectional diameter of the middle portion of the container side wall as compared to the other(s) of the upper plurality of cross-sectional diameters;

and wherein the yet another vertical distance is less than the maximum cross-sectional diameter of the middle portion of the container side wall.

24. The container of claim 23, wherein the resin is a polyethylene terephthalate (PET) resin.

25. The container of claim 24, wherein the metal is aluminum.

26. The container of claim 23, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

27. The container of claim 23, wherein the circular neck defines a first diameter that is vertically spaced from the upper boundary and greater than the diameter of the bottom of the base portion.

28. The container of claim 27, wherein the circular neck further defines a second diameter that is vertically spaced from the first diameter, different in size from the first diameter, and greater than the diameter of the bottom of the base portion.

29. The container of claim 28, wherein the circular neck further defines a third diameter that is adjacent the upper boundary of the container side wall, different in size from each of the first and second diameters, and greater than the diameter of the bottom of the base portion.

30. The container of claim 29, wherein the circular neck extends from the upper boundary of the container side wall so that the second diameter is different from the first diameter and the third diameter is different from each of the first and second diameters.

31. The container of claim 30, wherein the circular neck is angled.

32. The container of claim 31, wherein the circular neck is angled so that the first diameter is greater than the third diameter and the second diameter is greater than each of the first and third diameters.

33. The container of claim 29, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

34. A container, comprising:

a container body, the container body defining a first opening to an interior of the container body;

wherein the container body is adapted to receive a lid so that the lid is connected to the container body and covers the first opening to the interior of the container body;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the one of the lower plurality of cross-sectional diameters that is nearest to the maximum cross-sectional diameter of the middle portion of the container side wall as compared to the other(s) of the lower plurality of cross-sectional diameters; and the upper boundary of the container side wall adjacent to the circular neck of the container body;

and wherein the another vertical distance is less than the maximum cross-sectional diameter of the middle portion of the container side wall.

35. The container of claim 34, wherein the container body is made out of a resin; and wherein the resin is a polyethylene terephthalate (PET) resin.

36. The container of claim 34, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

37. The container of claim 34, further comprising:

the lid, which is received by the container body so that the lid is connected to the container body and covers the first opening to the interior of the container body.

38. The container of claim 37, wherein a first portion of the lid is above the circular neck of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape; and wherein the second portion of the lid defines a total area across which the second portion of the lid extends horizontally.

39. The container of claim 38, wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape; and wherein the arm is pivotable from a first position, in which the weakened or scored area is not deformed, to a second position, in which the weakened or scored area is deformed to provide a second opening to the interior of the container body.

40. The container of claim 37, wherein the lid is made of out of a metal.

41. The container of claim 34, wherein the circular neck defines a first diameter that is vertically spaced from the upper boundary and greater than the diameter of the bottom of the base portion.

42. The container of claim 41, wherein the circular neck further defines a second diameter that is vertically spaced from the first diameter, different in size from the first diameter, and greater than the diameter of the bottom of the base portion.

43. The container of claim 42, wherein the circular neck further defines a third diameter that is adjacent the upper boundary of the container side wall, different in size from each of the first and second diameters, and greater than the diameter of the bottom of the base portion.

44. The container of claim 43, wherein the circular neck extends from the upper boundary of the container side wall so that the second diameter is different from the first diameter and the third diameter is different from each of the first and second diameters.

45. The container of claim 44, wherein the circular neck is angled.

46. The container of claim 45, wherein the circular neck is angled so that the first diameter is greater than the third diameter and the second diameter is greater than each of the first and third diameters.

47. The container of claim 43, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

48. A container, comprising:

a container body, the container body defining a first opening to an interior of the container body;

wherein the container body is adapted to receive a lid so that the lid is connected to the container body and covers the first opening to the interior of the container body;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the bottom of the base portion; and the one of the upper plurality of cross-sectional diameters that is nearest to the maximum cross-sectional diameter of the middle portion of the container side wall as compared to the other(s) of the upper plurality of cross-sectional diameters;

and wherein the another vertical distance is less than the maximum cross-sectional diameter of the middle portion of the container side wall.

49. The container of claim 48, wherein the container body is made out of a resin; and wherein the resin is a polyethylene terephthalate (PET) resin.

50. The container of claim 48, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

51. The container of claim 48, further comprising:

the lid, which is received by the container body so that the lid is connected to the container body and covers the first opening to the interior of the container body.

52. The container of claim 51, wherein a first portion of the lid is above the circular neck of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape; and wherein the second portion of the lid defines a total area across which the second portion of the lid extends horizontally.

53. The container of claim 52, wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape; and wherein the arm is pivotable from a first position, in which the weakened or scored area is not deformed, to a second position, in which the weakened or scored area is deformed to provide a second opening to the interior of the container body.

54. The container of claim 51, wherein the lid is made of out of a metal.

55. The container of claim 48, wherein the circular neck defines a first diameter that is vertically spaced from the upper boundary and greater than the diameter of the bottom of the base portion.

56. The container of claim 55, wherein the circular neck further defines a second diameter that is vertically spaced from the first diameter, different in size from the first diameter, and greater than the diameter of the bottom of the base portion.

57. The container of claim 56, wherein the circular neck further defines a third diameter that is adjacent the upper boundary of the container side wall, different in size from each of the first and second diameters, and greater than the diameter of the bottom of the base portion.

58. The container of claim 57, wherein the circular neck extends from the upper boundary of the container side wall so that the second diameter is different from the first diameter and the third diameter is different from each of the first and second diameters.

59. The container of claim 58, wherein the circular neck is angled.

60. The container of claim 59, wherein the circular neck is angled so that the first diameter is greater than the third diameter and the second diameter is greater than each of the first and third diameters.

61. The container of claim 57, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

62. A container, comprising:

a container body, the container body defining a first opening to an interior of the container body;

wherein the container body is adapted to receive a lid so that the lid is connected to the container body and covers the first opening to the interior of the container body;

wherein the container body comprises a container side wall and a base portion connected to the container side wall;

wherein the base portion comprises a bottom and a first depression formed therein, the first depression extending upwardly from the bottom;

wherein a cross-sectional diameter of the first opening to the interior of the container body is less than a maximum cross-sectional diameter of a middle portion of the container side wall;

wherein the maximum cross-sectional diameter of the middle portion of the container side wall is a maximum cross-sectional diameter of the container side wall;

wherein the bottom of the base portion defines a diameter that is less than the maximum cross-sectional diameter of the middle portion of the container side wall;

wherein a lower portion of the container side wall extends downwardly from the middle portion of the container side wall to the base portion of the container body, the lower portion along its entirety being:

lesser in diameter than the maximum cross-sectional diameter of the middle portion of the container side wall; and greater in diameter than the base portion, including the bottom, thereby rendering the container body stemless;

wherein the container body further comprises a circular neck extending from the container side wall so that the container side wall extends between the circular neck and the base portion;

wherein an upper boundary of the container side wall is adjacent to the circular neck of the container body;

wherein an upper portion of the container side wall extends upwardly from the middle portion of the container side wall to the upper boundary of the container side wall, the upper portion along its entirety being:

lesser in diameter than the maximum cross-sectional diameter of the middle portion of the container side wall; and greater in diameter than the first opening to the interior of the container body;

wherein the container body contains a liquid therewithin;

wherein the interior of the container body extends continuously across the maximum cross-sectional diameter of the middle portion of the container side wall so as to be interrupted, if at all, only by the liquid contained within the container body;

wherein the circular neck defines a diameter that is greater than the diameter of the bottom of the base portion;

wherein the maximum cross-sectional diameter of the middle portion of the container side wall is vertically spaced from the bottom of the base portion;

wherein the upper portion of the container side wall defines an upper plurality of cross-sectional diameters, each of which:

is located at a respective vertical position along the upper portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein the lower portion of the container side wall defines a lower plurality of cross-sectional diameters, each of which:

is located at another respective vertical position along the lower portion of the container side wall;

is vertically spaced from each of the bottom of the base portion and the maximum cross-sectional diameter of the middle portion of the container side wall; and is less than the maximum cross-sectional diameter of the middle portion of the container side wall;

wherein a vertical distance is defined between:

one of the lower plurality of cross-sectional diameters that is nearest to the maximum cross-sectional diameter of the middle portion of the container side wall as compared to the other(s) of the lower plurality of cross-sectional diameters; and one of the upper plurality of cross-sectional diameters that is nearest to the maximum cross-sectional diameter of the middle portion of the container side wall as compared to the other(s) of the upper plurality of cross-sectional diameters;

wherein the vertical distance is less than the maximum cross-sectional diameter of the middle portion of the container side wall;

wherein another vertical distance is defined between:

the one of the lower plurality of cross-sectional diameters that is nearest to the maximum cross-sectional diameter of the middle portion of the container side wall as compared to the other(s) of the lower plurality of cross-sectional diameters; and the upper boundary of the container side wall adjacent to the circular neck of the container body;

wherein the another vertical distance is less than the maximum cross-sectional diameter of the middle portion of the container side wall;

wherein yet another vertical distance is defined between: the bottom of the base portion; and the one of the upper plurality of cross-sectional diameters that is nearest to the maximum cross-sectional diameter of the middle portion of the container side wall as compared to the other(s) of the upper plurality of cross-sectional diameters;

and wherein the yet another vertical distance is less than the maximum cross-sectional diameter of the middle portion of the container side wall.

63. The container of claim 62, wherein the container body is made out of a resin; and wherein the resin is a polyethylene terephthalate (PET) resin.

64. The container of claim 62, wherein the base portion further comprises a second depression adjacent the first depression;

wherein each of the first depression and the second depression at least partially defines a first outline; and wherein each of the first and second depressions increases in width as a radial distance from a center of the bottom of the base portion increases.

65. The container of claim 62, further comprising:

the lid, which is received by the container body so that the lid is connected to the container body and covers the first opening to the interior of the container body.

66. The container of claim 65, wherein a first portion of the lid is above the circular neck of the container body;

wherein the first portion of the lid defines a first circular shape;

wherein the first portion of the lid further defines a second circular shape around which the first circular shape circumferentially extends;

wherein the second circular shape defined by the first portion of the lid is concentric with the first circular shape defined by the first portion of the lid;

wherein a second portion of the lid extends horizontally and is positioned so that the second circular shape is radially positioned between the second portion of the lid and the first circular shape; and wherein the second portion of the lid defines a total area across which the second portion of the lid extends horizontally.

67. The container of claim 66, wherein the second portion of the lid comprises a weakened or scored area;

wherein the weakened or scored area is less than the total area across which the second portion of the lid extends horizontally;

wherein the lid further comprises an arm connected to the second portion of the lid and radially positioned within the second circular shape; and wherein the arm is pivotable from a first position, in which the weakened or scored area is not deformed, to a second position, in which the weakened or scored area is deformed to provide a second opening to the interior of the container body.

68. The container of claim 65, wherein the lid is made of out of a metal.

69. The container of claim 62, wherein the circular neck defines a first diameter that is vertically spaced from the upper boundary and greater than the diameter of the bottom of the base portion.

70. The container of claim 69, wherein the circular neck further defines a second diameter that is vertically spaced from the first diameter, different in size from the first diameter, and greater than the diameter of the bottom of the base portion.

71. The container of claim 70, wherein the circular neck further defines a third diameter that is adjacent the upper boundary of the container side wall, different in size from each of the first and second diameters, and greater than the diameter of the bottom of the base portion.

72. The container of claim 71, wherein the circular neck extends from the upper boundary of the container side wall so that the second diameter is different from the first diameter and the third diameter is different from each of the first and second diameters.

73. The container of claim 72, wherein the circular neck is angled.

74. The container of claim 73, wherein the circular neck is angled so that the first diameter is greater than the third diameter and the second diameter is greater than each of the first and third diameters.

75. The container of claim 71, wherein the first and second diameters defined by the circular neck are at first and second vertical positions, respectively; and wherein the circular neck extends from the upper boundary of the container side wall to an upper boundary of the circular neck, including through the first and second vertical positions, such that the circular neck defines a continuous line that extends from the upper boundary of the container side wall at an oblique angle, and that extends upwardly along any segment defined by any two points along the continuous line.

* * * * *